US009416603B2

(12) United States Patent
Nielsen et al.

(10) Patent No.: US 9,416,603 B2
(45) Date of Patent: Aug. 16, 2016

(54) TUBING INJECTOR WITH BUILT IN REDUNDANCY

(76) Inventors: Shawn Nielsen, Spruce Grove (CA); Sinisa Dobrijevic, Edmonton (CA); Robert Ewen, Houston, TX (US)

( * ) Notice: Subject to any disclaimer, the term of this patent is extended or adjusted under 35 U.S.C. 154(b) by 571 days.

(21) Appl. No.: 13/992,657

(22) PCT Filed: Dec. 8, 2011

(86) PCT No.: PCT/CA2011/050759
§ 371 (c)(1),
(2), (4) Date: Oct. 18, 2013

(87) PCT Pub. No.: WO2012/075585
PCT Pub. Date: Jun. 14, 2012

(65) Prior Publication Data

US 2014/0034292 A1 Feb. 6, 2014

(30) Foreign Application Priority Data

Dec. 8, 2010 (CA) ..... 2724860

(51) Int. Cl.
*E21B 19/22* (2006.01)

(52) U.S. Cl.
CPC ..... *E21B 19/22* (2013.01)

(58) Field of Classification Search
CPC ..... E21B 19/22; B65G 15/14; B65G 15/12; B65G 21/12
USPC ..... 405/168.4
See application file for complete search history.

(56) References Cited

U.S. PATENT DOCUMENTS

| | | | | |
|---|---|---|---|---|
| 5,553,668 | A | 9/1996 | Council et al. | |
| 5,845,708 | A | 12/1998 | Burge et al. | |
| 5,850,874 | A | 12/1998 | Burge et al. | |
| 6,116,345 | A | 9/2000 | Fontana et al. | |
| 6,209,634 | B1 | 4/2001 | Avakov et al. | |
| 6,216,780 | B1 | 4/2001 | Goode et al. | |
| 6,347,664 | B1 | 2/2002 | Perio, Jr. | |
| 6,439,445 | B1 * | 8/2002 | De Groot | F16L 1/23 226/172 |
| 6,609,566 | B2 | 8/2003 | Perio, Jr. | |
| 6,719,043 | B2 | 4/2004 | Austbo et al. | |
| 6,968,894 | B2 | 11/2005 | Austbo et al. | |
| 7,124,815 | B2 | 10/2006 | Rosine et al. | |
| 7,226,244 | B1 * | 6/2007 | De Groot | F16L 1/19 405/166 |
| 7,467,659 | B2 * | 12/2008 | Nielsen | E21B 19/22 166/77.2 |
| 8,104,995 | B2 * | 1/2012 | Roodenburg | F16L 1/23 226/172 |
| 8,794,874 | B2 * | 8/2014 | Roodenburg | B65H 51/105 405/158 |
| 2009/0250205 | A1 * | 10/2009 | Koopmans | E21B 19/22 166/66.4 |

FOREIGN PATENT DOCUMENTS

| | | | |
|---|---|---|---|
| AU | 704634 | B2 | 10/1996 |
| AU | 730344 | B2 | 11/1997 |
| AU | 727991 | B2 | 4/1998 |
| AU | 723903 | B2 | 5/1999 |

(Continued)

*Primary Examiner* — Robert E Fuller
(74) *Attorney, Agent, or Firm* — Christensen O'Connor Johnson Kindness PLLC

(57) ABSTRACT

A tubing injector has a first injector pair and a second pair of cooperating injector mechanisms. The first injector pair are positioned on a first track and the second pair are positioned on a second track. The tubing injector provides redundancy to address safety concerns. The first injector pair is movable to the engaged position, when the second injector pair is moved to the disengaged position and vice versa.

3 Claims, 4 Drawing Sheets

(56) References Cited

FOREIGN PATENT DOCUMENTS

| | | | |
|---|---|---|---|
| AU | 731368 | B2 | 5/1999 |
| CA | 2214798 | A1 | 9/1996 |
| CA | 2239096 | C | 10/1997 |
| CA | 2239021 | C | 12/2006 |
| WO | 9628633 | A2 | 9/1996 |
| WO | 9740255 | A2 | 10/1997 |
| WO | 9814686 | A1 | 4/1998 |

* cited by examiner

TUBING INJECTOR WITH BUILT IN REDUNDANCY

FIELD

There is described a tubing injector that is used to inject coiled tubing into a well bore.

BACKGROUND

U.S. Pat. No. 7,467,659 (Nielsen et al.) discloses a tubing injector with injector mechanisms that move that are capable of moving toward each other or away from each other. There is no redundancy in the Nielsen et al mechanism should one of the injector mechanisms fail. The 2010 BP off shore oil well disaster in the Gulf of Mexico has demonstrated a need for back up systems, should primary systems fail. What is required is a tubing injector with built in redundancy.

SUMMARY

There is provided a tubing injector which includes a base mountable to a wellhead with a bore positioned on a vertical axis in alignment with a bore of the wellhead. At least one body is detachably secured to the base. A first track is positioned on a first horizontal axis extending outwardly away from the vertical axis on opposed sides of the body. A second track is positioned on a second horizontal axis extending outwardly away from the vertical axis on opposed sides of the body and circumferentially spaced about the vertical axis relative to the first horizontal axis. A first injector pair of cooperating injector mechanisms one of which is positioned on each side of the vertical axis, the first injector pair being movable along with first track between an engaged positioned engaging tubing positioned in the bore of the wellhead and a disengaged position spaced from the vertical axis. A second injector pair of cooperating injector mechanisms one of which is positioned on each side of the vertical axis, the second injector pair being movable along with second track between an engaged positioned engaging tubing positioned in the bore of the wellhead and a disengaged position spaced from the vertical axis.

There may be a separate body for each injector that makes up the tubing injector as a whole. A first body supports a portion of the first track on which one of the first injector pair travels. A second body supports a portion of the first track on which another of the first injector pair travels. A third body supports a portion of the second track on which one of the second injector pair travels and a fourth body supports a portion of the second track on which another of the second injector pair travels. A selected injector is removable for repair or replacement by removing from the base one of the first body, the second body, the third body, or the fourth body that supports the selected injector. When the unit is being used with offshore drilling rigs and is positioned on the sea bed, an injector may be removed and replaced by a robot vehicle. The robot vehicle can dive down to the tubing injector, detach the body which supports the injector to be removed and then replace it with a new injector.

The tubing injector, as described above, provides redundancy to address safety concerns. The first injector pair is movable to the engaged position, when the second injector pair is moved to the disengaged position. Conversely, the second injector pair is movable to the engaged position, when the second injector pair in moved to the disengaged position. When in the disengaged position, the first injector pair is removable for repair or replacement. Similarly, when in the disengaged position, the second injector pair is removable for repair or replacement.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
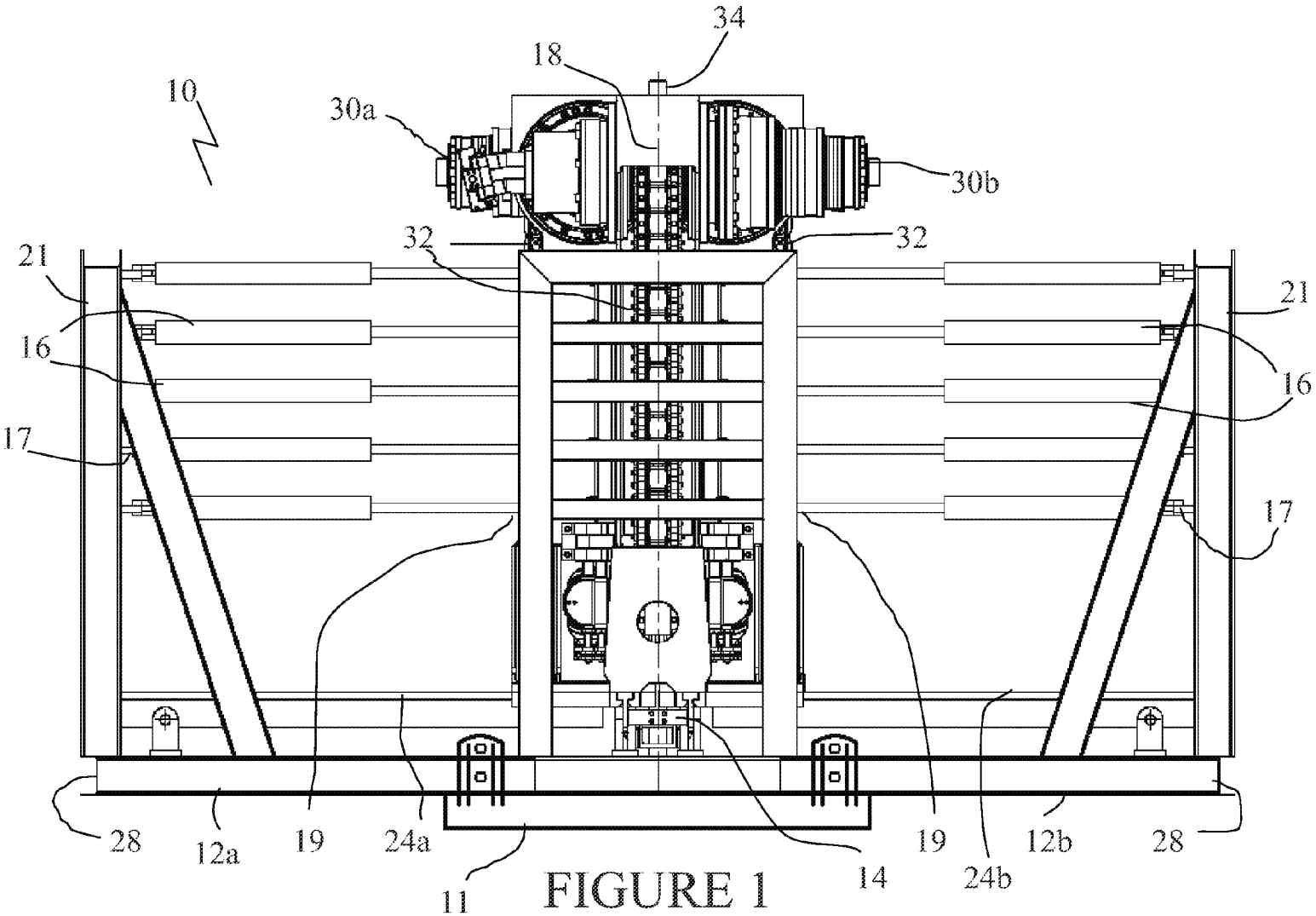
FIG. 1 is a front elevation view of a tubing injector with built in redundancy.

A tubing injector generally identified by reference numeral 10, will now be described with reference to FIGS. 1-3.

Structure and Relationship of Parts

Referring to FIG. 1, a tubing injector 10 includes a base 11 mountable to a wellhead, not shown with a bore positioned on a vertical axis 18 in alignment with a bore of the wellhead. At least one body 12 is detachably secured to the base by a coupling 14. Referring to FIG. 3, a first track 20 is positioned on a first horizontal axis 22 and extends outwardly away from vertical axis 18 on opposed sides 28 of body 12. A second track 24 is positioned on a second horizontal axis 26 and extends outwardly away from vertical axis 18 on opposed sides 28 of body 12. Second track 24 is circumferentially spaced about vertical axis 18 relative to first horizontal axis 22.

A first injector pair 30 of cooperating injector mechanisms 32 is positioned such that one is positioned on each side of vertical axis 18. First injector pair 30 is movable along with first track 20 between an engaged positioned and a disengaged position by expandable hydraulic cylinders 16. Hydraulic cylinders 16 have a first end 17 and a second end 19. First end 17 is attached to a vertical reaction frame 21 on body 12 and second end 19 is attached to first track 20 or second track 24. In the engaged position, first injector pair 30 engages tubing 34 positioned in the bore of wellhead 16. In the disengaged position, first injector pair 30 is spaced from vertical axis 18. A second injector pair 36 of cooperating injector mechanisms 30 is positioned such that one is positioned on each side of vertical axis 18. Second injector pair 36 is movable along with second track 24 between an engaged positioned and a disengaged position. In the engaged position, second injector pair 36 engages tubing 34 positioned in the bore of wellhead 16. In the disengaged position, second injector pair 36 is spaced from vertical axis 18. First injector pair 30 is movable to the engaged position when second injector pair 36 is moved to the disengaged position. Second injector pair 36 is movable to the engaged position when first injector pair 30 is moved to the disengaged position. When in the disengaged position, first injector pair 30 or second injector pair 36 are removable from first track 20 and second track 24, respectively.

Figure 3:
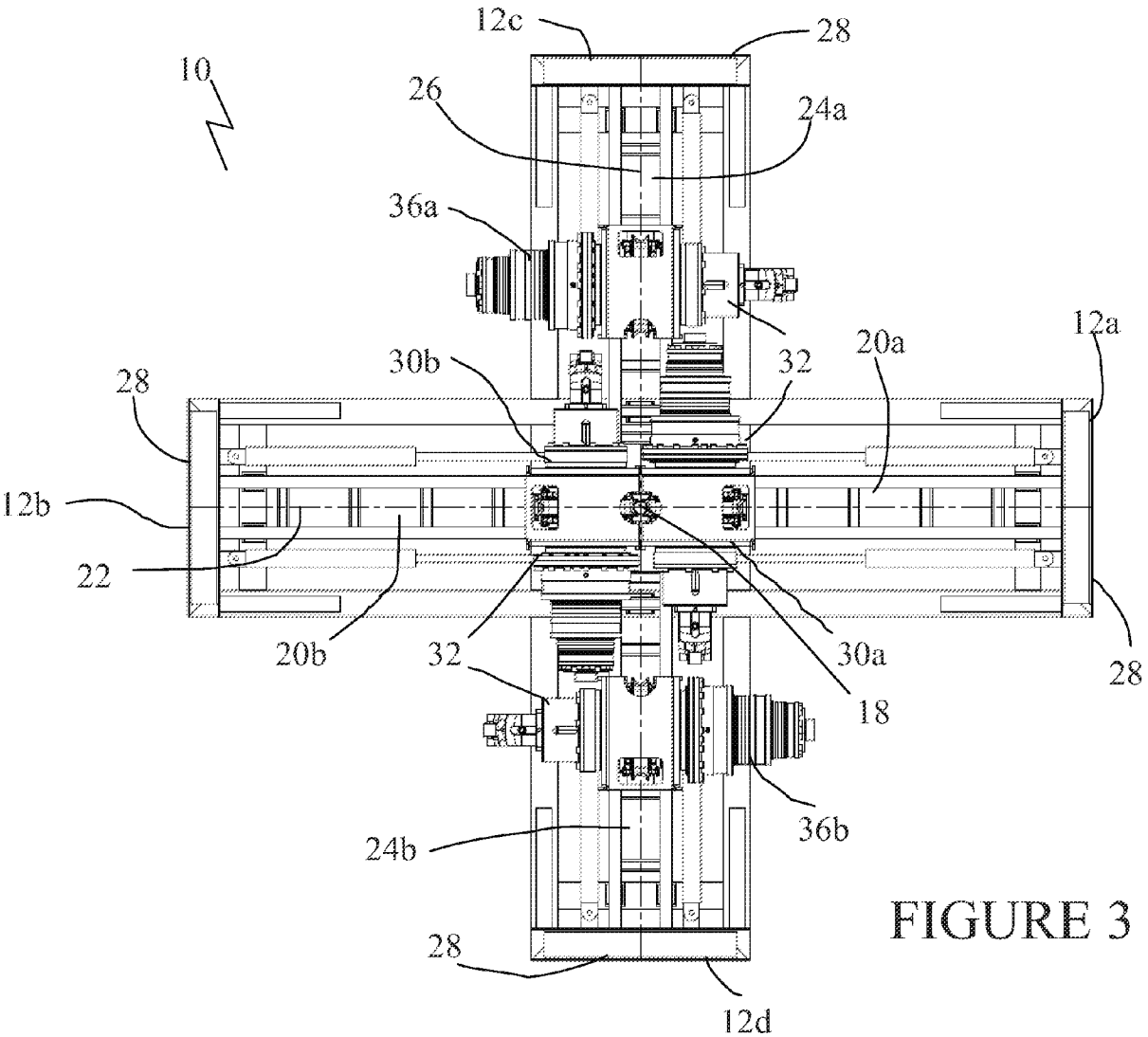
FIG. 3 is a top plan view of the tubing injector with built in redundancy shown in FIG. 1.
Figure 4:
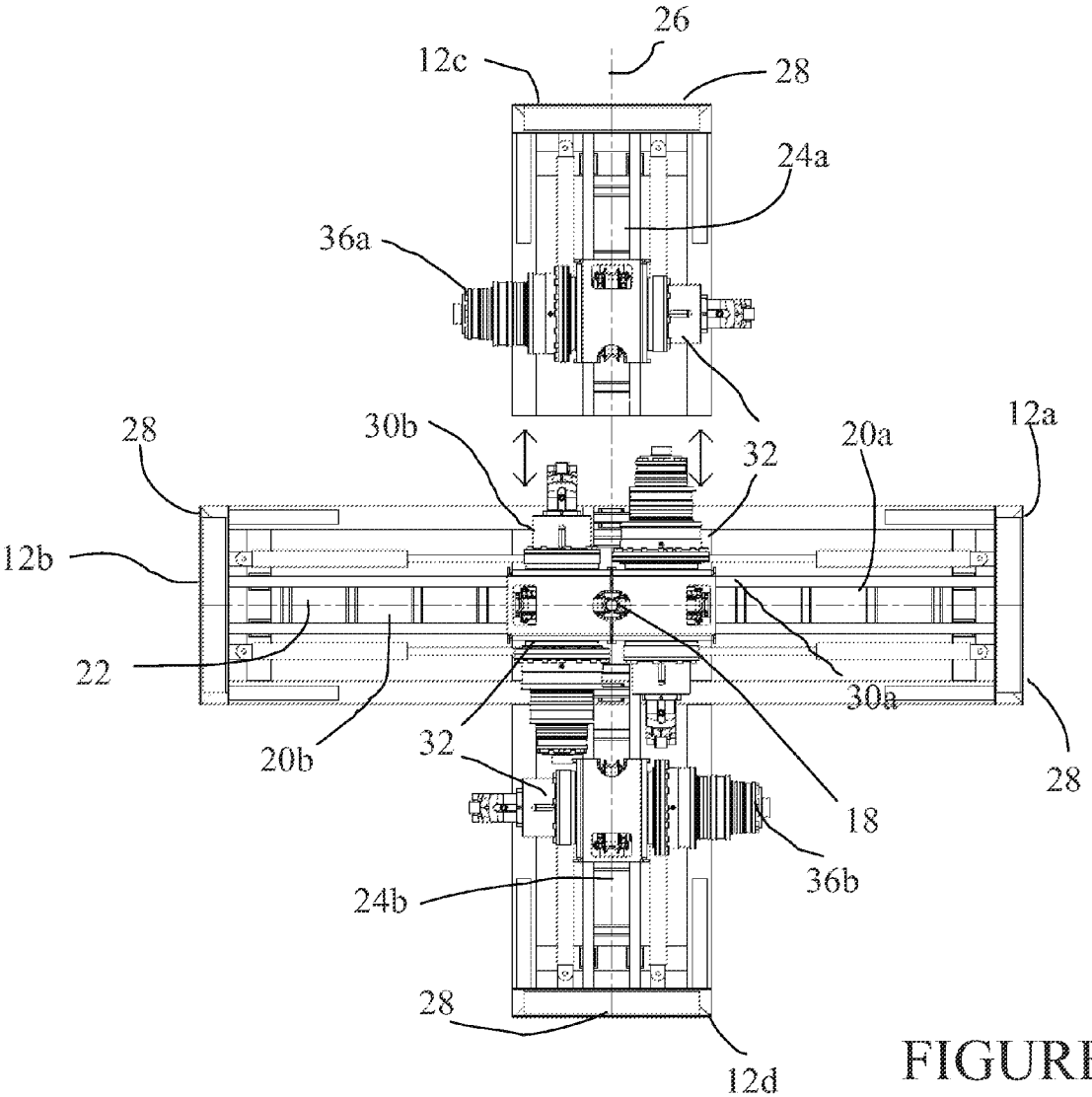
FIG. 4 is a top plan view of the tubing injector with built in redundancy shown in FIG. 3 with a body with corresponding track and injector removed.

Referring to FIG. 3, in the preferred embodiment, there is a separate body 12*a*, 12*b*, 12*c* and 12*d* for each injector. A first body 12*a* supports a first portion 20*a* of first track 20 on which one of the injectors 30*a* of the first injector pair 30 travels. A second body 12*b* supports a second portion 20*b* of first track 20 on which another injector 30*b* of the first injector pair 30 travels. A third body 12*c* supports a first portion 24*a* of second track 24 on which one of the injectors 36*a* of the second injector pair 36 travels. A fourth body 12*d* supports a second portion 24*b* of the second track 24 on which another injector 36*b* of the second injector pair 36 travels. When an injector 30*a*, 30*b*, 36*a* or 36*b* is selected for removal for repair or replacement, it is removed by removing one of first body 12*a*, second body 12 *b*, third body 12*c*, or fourth body 12*d* from base 11. When a body 12*a*, 12*b*, 12*c* or 12*d* is removed from base 11, the corresponding track 20*a*, 20*b*, 24*a* or 24*c* and injector 30*a*, 30*b*, 36*a* and 36*b* are removed as a group. Referring to FIG. 4, when body 12*c* is removed from base 11, corresponding track 24*a* and injector 36*a* are also removed as a unit.

Operation

Figure 2:
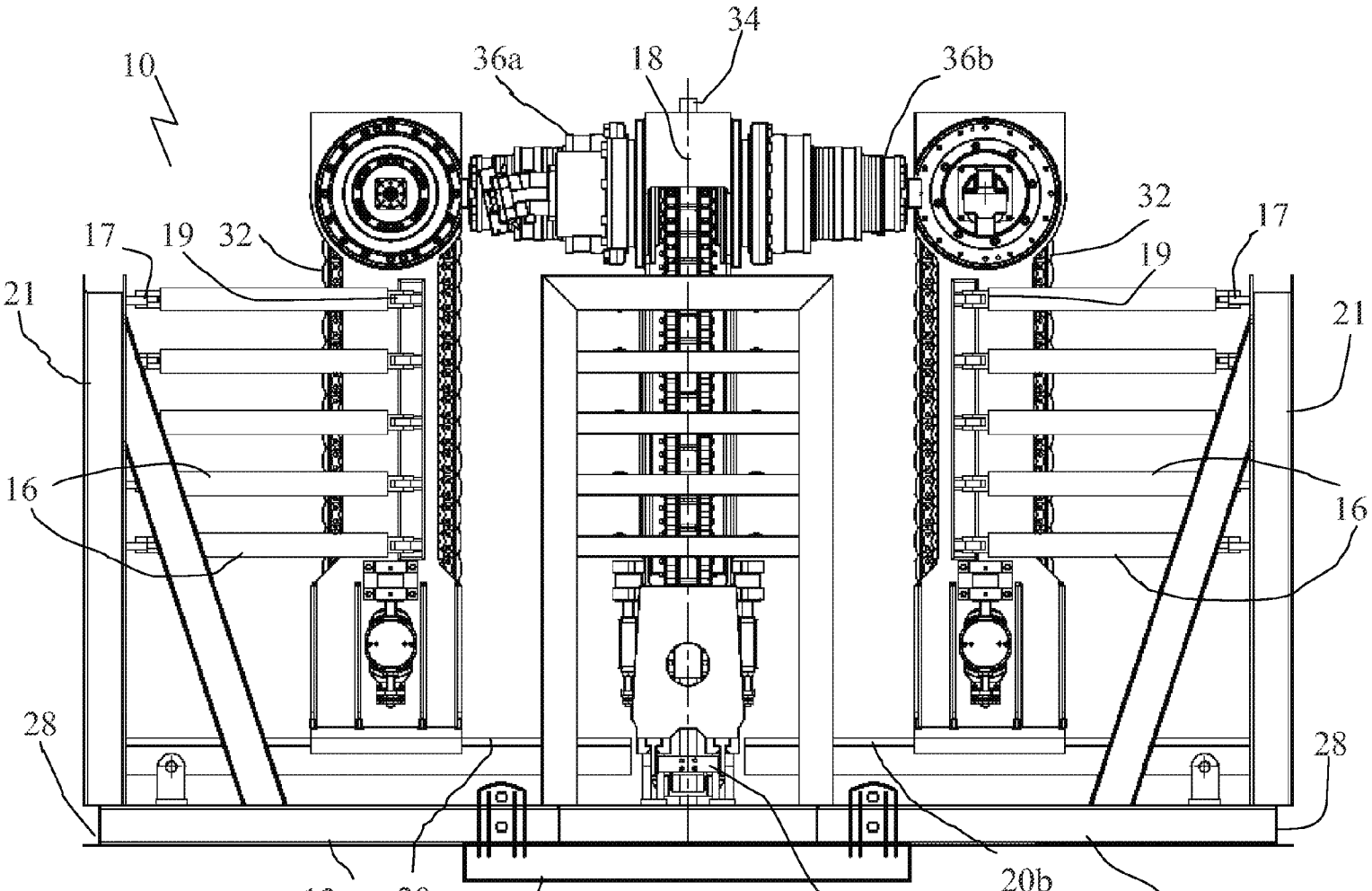
FIG. 2 is a side elevation view of the tubing injector with built in redundancy shown in FIG. 1.

Referring to FIG. 2, body 12 of tubing injector 10 is connected to wellhead 16 by coupling 14. Referring to FIG. 3, first track 20 is positioned on first horizontal axis 22 and second track 24 is positioned on second horizontal axis 26. Second track 24 is circumferentially spaced about vertical axis 18 relative to first horizontal axis 22. First injector pair 30 of cooperating injector mechanisms 32 is positioned such that one is positioned on each side of vertical axis 18 and is movable along with first track 20 between an engaged positioned and a disengaged position. In FIG. 3, first injector pair 30 is in the engaged position. Second injector pair 36 of cooperating injector mechanisms 30 is positioned such that one is positioned on each side of vertical axis 18 and is movable along with second track 24 between an engaged positioned and a disengaged position. In FIG. 3, second injector pair 36 is in the disengaged position.

When first injector pair 30 is in the engaged position and in contact with tubing 34, second injector pair 36 is in the disengaged position. While second injector pair 36 is in the disengaged position, injectors 36 are removable from second track 24 for repair or replacement. When first injector pair 30 becomes worn or requires service or replacement it is moved to the disengaged position by expanding hydraulic cylinders 16 attached to first track 20 and second injector pair 36 engage tubing 34 by contracting hydraulic cylinders 16 attached to second track 24*h*. This allows continued use of tubing injector 10 while allowing maintenance on the disengaged injector pairs.

Referring to FIG. 3, in the event that an injector 30*a*, 30*b*, 36*a* or 36*b* is to be removed, the corresponding body 12*a*, 12*b*, 12*c* or 12*d*, respectively, is removed from base 11. A portion of track 20*a*, 20*b*, 24*a* or 24*b* is also removed at the same time and a new body 12 with corresponding injector and track is attached to base 11. Referring to FIG. 4, when body 12*c* is removed from base 11, corresponding track 24*a* and injector 36*a* are also removed as a unit.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A tubing injector, comprising:

a base mountable to a wellhead and having a bore positioned on a vertical axis in alignment with a bore of the wellhead;

at least one body detachably secured to the base;

a first track positioned on a first horizontal axis and extending outwardly away from the vertical axis on opposed sides of the base;

a second track positioned on a second horizontal axis and extending outwardly away from the vertical axis on opposed sides of the base and circumferentially spaced about the vertical axis relative to the first horizontal axis;

a first injector pair of cooperating injector mechanisms, one of which is positioned on each side of the vertical axis, the first injector pair being movable along with the first track between an engaged position engaging tubing positioned in the bore of the wellhead and a disengaged position spaced from the vertical axis;

a second injector pair of cooperating injector mechanisms, one of which is positioned on each side of the vertical axis, the second injector pair being movable along with the second track between an engaged position engaging tubing positioned in the bore of the wellhead and a disengaged position spaced from the vertical axis;

the first injector pair being movable to the engaged position when the second injector pair is moved to the disengaged position and the second injector pair being movable to the engaged position when the first injector pair is moved to the disengaged position;

when in the disengaged position, either one of the first injector pair being removable for repair or replacement; and when in the disengaged position, either one of the second injector pair being removable for repair or replacement.

2. The tubing injector of claim 1, wherein there is a separate body for each injector, a first body supporting a portion of the first track on which one of the first injector pair travels, a second body supporting a portion of the first track on which another of the first injector pair travels, a third body supporting a portion of the second track on which one of the second injector pair travels, and a fourth body supporting a portion of the second track on which another of the second injector pair travels, and a selected one of the injectors being removable for repair or replacement by removing from the base one of the first body, the second body, the third body, or the fourth body supporting the selected injector.

3. The tubing injector of claim 1, wherein the at least one body is detachably secured to the base by fasteners, the at least one body being released from the base upon removal or release of the fasteners.

* * * * *